US007549517B2

(12) United States Patent
Stanley et al.

(10) Patent No.: US 7,549,517 B2
(45) Date of Patent: Jun. 23, 2009

(54) ELEVATOR CAR DISPATCHING INCLUDING PASSENGER DESTINATION INFORMATION AND A FUZZY LOGIC ALGORITHM

(75) Inventors: Jannah A. Stanley, Cromwell, CT (US); Hideyuki Honma, Shukugawara (JP); Daniel S. Williams, Southington, CT (US); Toshimitsu Mori, Kanagawa (JP); Paul Simcik, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 577 days.

(21) Appl. No.: 11/214,089

(22) Filed: Aug. 29, 2005

(65) Prior Publication Data

US 2007/0045052 A1 Mar. 1, 2007

(51) Int. Cl.
*B66B 1/18* (2006.01)

(52) U.S. Cl. ..... 187/382; 187/392

(58) Field of Classification Search ..... 187/380–388, 187/247, 391–393, 396

See application file for complete search history.

(56) References Cited

U.S. PATENT DOCUMENTS

| | | | | |
|---|---|---|---|---|
| 4,718,520 | A | 1/1988 | Schroder | |
| 4,989,694 | A * | 2/1991 | Ueshima et al. | 187/380 |
| 5,022,498 | A * | 6/1991 | Sasaki et al. | 187/387 |
| 5,233,138 | A * | 8/1993 | Amano | 187/382 |
| 5,563,386 | A * | 10/1996 | Powell et al. | 187/382 |
| 5,668,356 | A | 9/1997 | Powell et al. | |
| 6,401,874 | B2 * | 6/2002 | Siikonen | 187/382 |
| 7,040,458 | B2 * | 5/2006 | Forsythe et al. | 187/396 |

* cited by examiner

*Primary Examiner*—Jonathan Salata
(74) *Attorney, Agent, or Firm*—Carlson, Gaskey & Olds PC

(57) ABSTRACT

An elevator system includes a controller that uses one of a plurality of fuzzy logic algorithms for assigning an elevator car to service a passenger request. One example uses a passenger's desired destination as indicated by the passenger service request prior to the passenger entering an elevator car. One example includes multiple fuzzy logic algorithms, each corresponding to a particular relationship between an elevator car's current assignments, a passenger's desired destination, a source landing of the passenger's request, or a combination of them.

25 Claims, 3 Drawing Sheets

ELEVATOR CAR DISPATCHING INCLUDING PASSENGER DESTINATION INFORMATION AND A FUZZY LOGIC ALGORITHM

FIELD OF THE INVENTION

This invention generally relates to elevator systems. More particularly, this invention relates to assigning elevator cars to respond to passenger requests.

DESCRIPTION OF THE RELATED ART

Elevator systems have been in use for many years. Traditional elevator systems include hall call buttons located near an entrance to an elevator shaft. Passengers use hall call buttons to indicate a desire to travel up or down from their current location. Upon entering the elevator car, the passenger utilizes a car operating panel to indicate the destination they intend to reach. The elevator car then travels to the appropriate destination where the passenger can exit the elevator.

Various control schemes have been proposed for assigning elevator cars to respond to passenger requests. In some buildings, it is desirable to use particular control algorithms to manage elevator traffic to handle particular traffic conditions. For example, some elevator systems are designed to assign elevator cars in a way that minimizes wait time for passengers at a lobby level, for example.

One known dispatching technique includes using fuzzy logic for assigning elevator cars to respond to passenger requests placed using hall call buttons. U.S. Pat. No. 5,668,356 describes such an arrangement. For such systems, the elevator dispatcher does not know the destination of passengers until the passengers board the elevator and enter their destinations with the car operating panel buttons. Such systems are not able to discern how many passengers are waiting behind a hall call or how many passengers are associated with each destination call or car call because the hall call buttons and the car operating panel buttons do not provide an indication of how many individuals correspond to each request. For example, four people may enter an elevator all intending to travel to the same destination but the destination button on the car operating panel is only pressed once, typically.

Although it has been possible to estimate how many passengers were waiting behind a hall call based on past observed traffic patterns or sensors located at a lobby level, for example, those approaches have been adopted in a way that has only limited usefulness within elevator dispatching control schemes. For example, hardware crowd sensors typically add cost and there are challenges associated with installing and locating them in a manner that makes it acceptable to building owners and architects, for example. Further, the number of floors at which such sensors can be installed for a group of elevators is limited and can only provide limited information.

Another elevator car dispatching technique is associated with the so-called destination entry systems. A typical destination entry system includes a device that allows a passenger to request elevator service and to indicate the passenger's intended destination before the passenger enters an elevator car. Such systems provide an advantage in that an elevator car dispatching algorithm can take into account the passenger's intended destination as part of the car assignment technique. Various proposals in this regard have been made.

Those skilled in the art are always striving to make improvements. It would be useful to enhance the capability of known elevator car assignment techniques to improve passenger service. This invention addresses that need.

SUMMARY OF THE INVENTION

An exemplary disclosed method of controlling an elevator system includes assigning an elevator car to respond to a passenger request based upon the desired destination of the passenger and a fuzzy logic car assignment algorithm. In a disclosed example the passenger request indicates the passenger's desired destination before the passenger enters an elevator car. One example includes determining whether a candidate elevator car is currently assigned to travel to the desired destination and using one of a plurality of fuzzy logic car assignment algorithms based upon that determination.

One disclosed example includes determining whether a candidate elevator car is assigned to travel to a source landing of the passenger request from which the passenger will board an elevator car to be carried to the desired destination. One example includes determining a type of call that the candidate elevator car is assigned to respond to when traveling to the source landing. A corresponding one of a plurality of fuzzy logic algorithms is selected responsive to the determined type of call.

A disclosed example includes providing more than one fuzzy logic algorithm depending on the relationship between an elevator car's current assignments and the passenger request including the source landing of the request and the passenger's desired destination.

One disclosed example includes determining whether a candidate elevator car will have enough capacity to receive the passenger at the source landing. One example includes using passenger destination information to determine an estimate of how many passengers will be on the elevator car or will board the elevator car at the source landing as part of determining whether a candidate elevator car has enough capacity to service the passenger request.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Disclosed example embodiments of this invention provide elevator car dispatching techniques that include using passenger destination information and a fuzzy logic car assignment algorithm.

Figure 1:
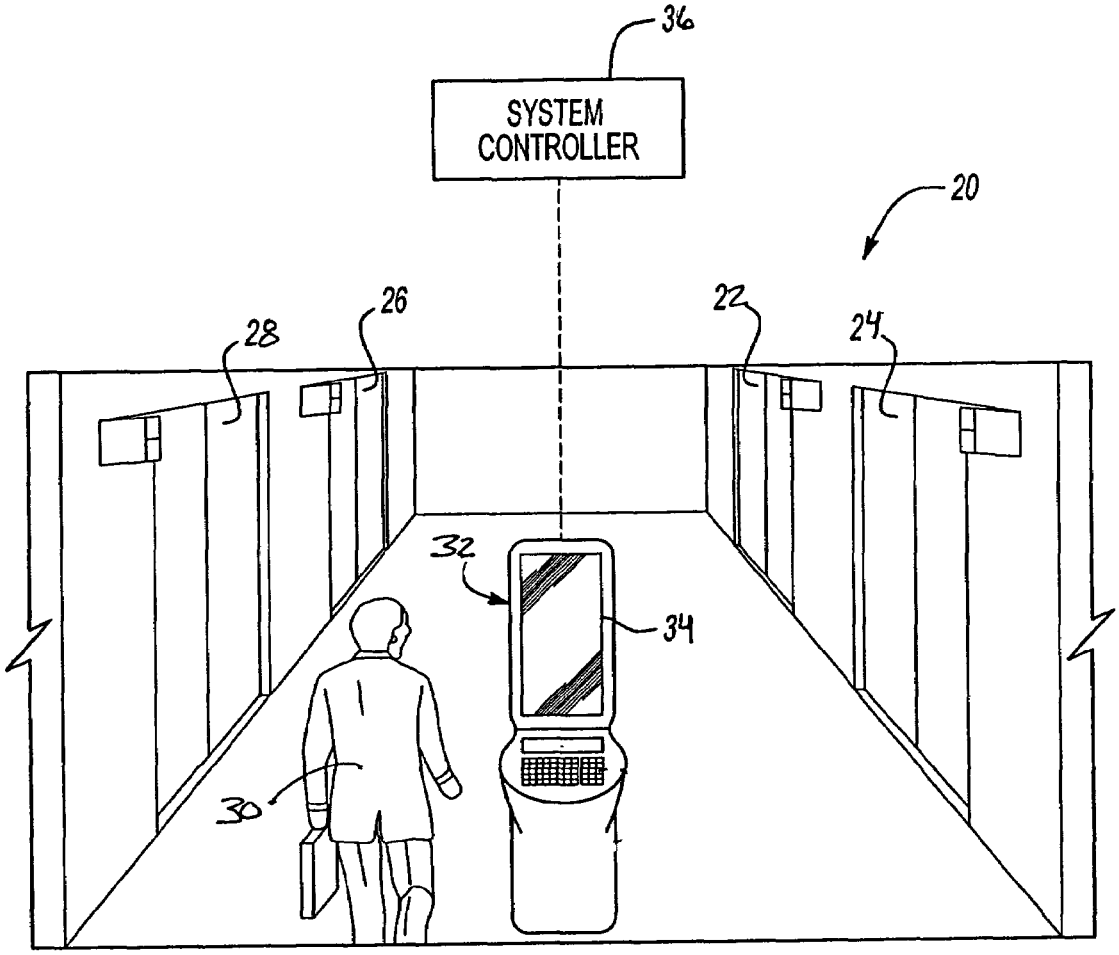
FIG. 1 schematically shows selected portions of an elevator system designed according to an embodiment of this invention.

FIG. 1 schematically shows selected portions of an elevator system 20. A plurality of elevator cars 22, 24, 26 and 28 are arranged in a known manner to carry passengers 30 between various levels within a building, for example. The illustrated example includes a destination entry device 32 that allows a passenger 30 to provide an indication of the passenger's desired destination before the passenger 30 enters one of the elevator cars 22-28. The example destination entry device 32 includes a passenger interface 34 that allows the passenger to use a known technique for placing a service request indicating the desired destination. A controller 36 receives the passenger service requests and assigns particular cars 22-28 to carry passengers to their desired destinations. The controller 36 in one example controls the passenger interface 34 to notify the passenger which car has been assigned to their request.

A single controller 36 is schematically shown in the example of FIG. 1 for discussion purposes. Those skilled in the art who have the benefit of this description will realize how many processors or controllers and what combination of software, hardware or firmware will best meet the needs of their particular situation for performing the functions of the example controller 36.

In one example, the controller 36 uses various dispatching algorithms for assigning elevator cars to desired passenger destinations. One example includes using fuzzy logic assignment algorithms based upon decision-making techniques similar to those described in U.S. Pat. No. 5,668,356. The teachings of that document are incorporated into this description by reference.

One example includes selecting one of a plurality of fuzzy logic algorithms for determining whether a particular one of the elevator cars should be assigned to service a particular passenger service request. In one example, the selection of the fuzzy logic algorithm depends on a relationship between the passenger request and the current assignments for a candidate elevator car. One example includes using the passenger's desired destination, which is known before the passenger enters an elevator car, as a factor in deciding which fuzzy logic algorithm to use before deciding whether to assign a particular elevator car to service the passenger's request. Another factor used in a disclosed example is the source landing of the passenger request from which the passenger will board an elevator car to be carried to the desired destination.

Figure 2:
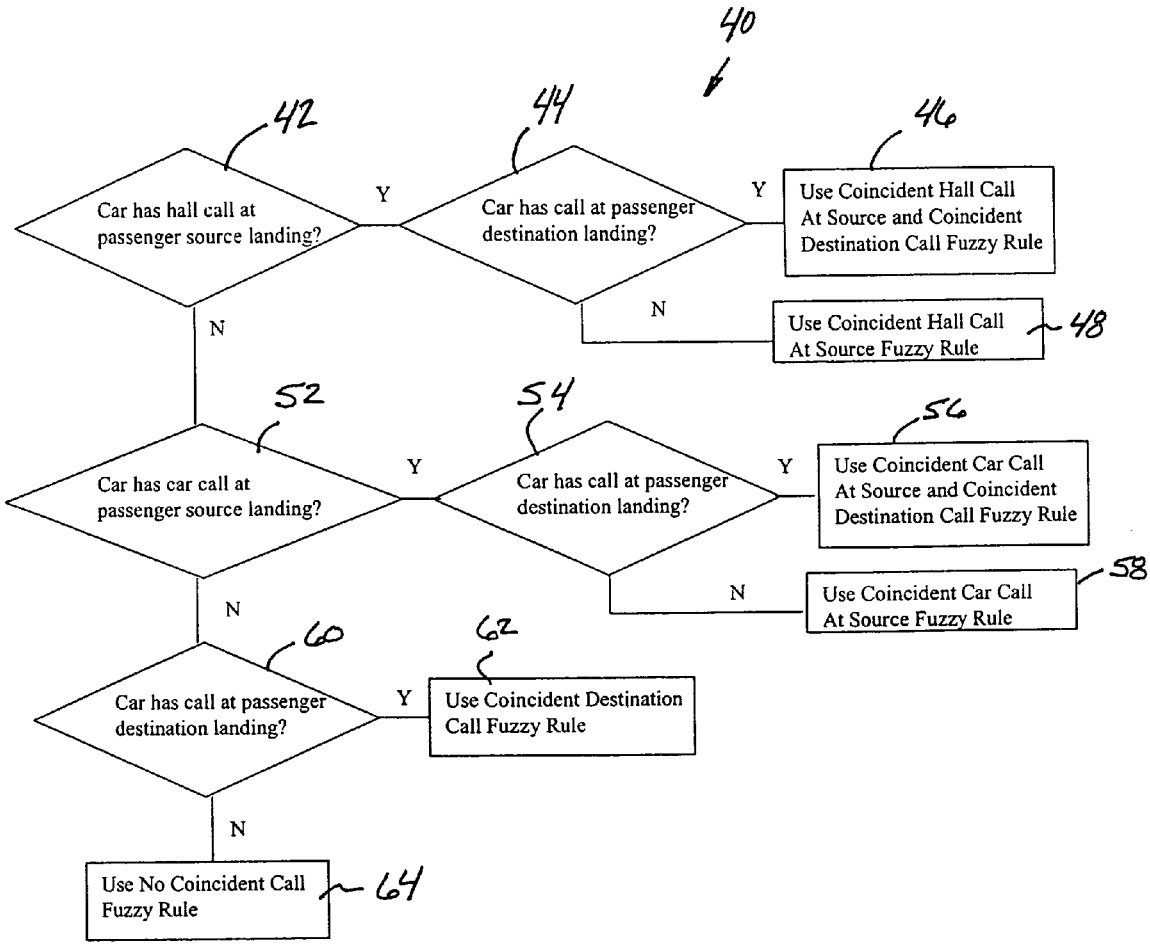
FIG. 2 is a flowchart diagram summarizing one example approach for assigning an elevator car to respond to a passenger request.

FIG. 2 includes a flowchart diagram 40 that summarizes one example approach for determining which fuzzy logic algorithm to use when making an elevator car assignment. The example of FIG. 2 begins at 42 where a determination is made whether an elevator car under consideration (i.e., a candidate elevator car) has a hall call at the source landing of the passenger request. A hall call in this context includes a request for passenger service from the same landing as the source landing of the passenger request under consideration. In other words, a determination is made at 42 whether a candidate elevator car is already assigned to travel to the source landing of the passenger request to board a passenger. If so, a determination is made at 44 whether the same elevator car already has a call at the passenger's desired destination. In other words, the determination at 44 includes determining whether the elevator car under consideration is already assigned to travel to the same destination indicated by the passenger's request.

When the determinations at 42 and 44 are both positive, the example of FIG. 2 continues at 46 and a coincident hall call at the source landing and a coincident destination call fuzzy logic algorithm is applied for determining whether to assign that elevator car to that passenger request. If the determination at 42 is positive but the determination at 44 is negative, then another fuzzy logic algorithm is selected at 48, which is referred to as a coincident hall call at the source landing fuzzy logic algorithm in this example.

Assuming that the candidate elevator car does not have a hall call at the passenger source landing, a determination is made at 52 whether the elevator car has a car call at the passenger source landing. A car call in this context is used to refer to an assignment for that elevator car to travel to the source landing of the passenger request under consideration for purposes of dropping off a passenger, who is already on the elevator car, at the source landing. If so, a determination is made at 54 whether that elevator car has a call at the passenger's desired destination. This is the same determination made at 44, for example.

When the determinations at 52 and 54 in the example of FIG. 2 are both positive, a corresponding fuzzy logic algorithm is selected at 56, which is referred to as a coincident car call at the source landing and coincident destination call fuzzy logic algorithm. If the car under consideration has a car call at the source landing for the passenger request but does not have a coincident destination call, then a fuzzy logic algorithm referred to as a coincident car call at the source landing is selected at 58.

For situations where a candidate elevator car does not have a hall call or a car call at the source landing of the passenger request, a determination is made at 60 whether the candidate elevator car has a call at the passenger's intended destination. In other words, a determination is made at 60 whether the passenger's desired destination indicated in the request under consideration is the same as a destination to which that the elevator car is already assigned to travel. If so, a coincident destination call fuzzy logic algorithm is used at 62 for determining whether to assign that car to service that passenger request.

In the example of FIG. 2, when the determinations made at 42, 52 and 60 are all negative, a fuzzy logic algorithm referred to as a no incident call algorithm is used at 64 for determining whether the candidate elevator car can be used to service the passenger request under consideration.

As can be appreciated from the example of FIG. 2, a plurality of possible fuzzy logic algorithms may be used depending on the relationship between the passenger's request and the current assignment for an elevator car. In particular, whether there is a coincident stop (e.g., another call including the same floor as the source or destination) within the elevator car's current assignments and the passenger's desired destination is used as a factor for deciding which fuzzy logic algorithm to apply when assigning an elevator car.

The fuzzy logic algorithms mentioned in this description can take a variety of forms. Those skilled in the art who have the benefit of this description and information regarding known fuzzy logic car assignment algorithms will be able to develop an algorithm that meets the particular needs of an elevator system for a given situation.

Figure 3:
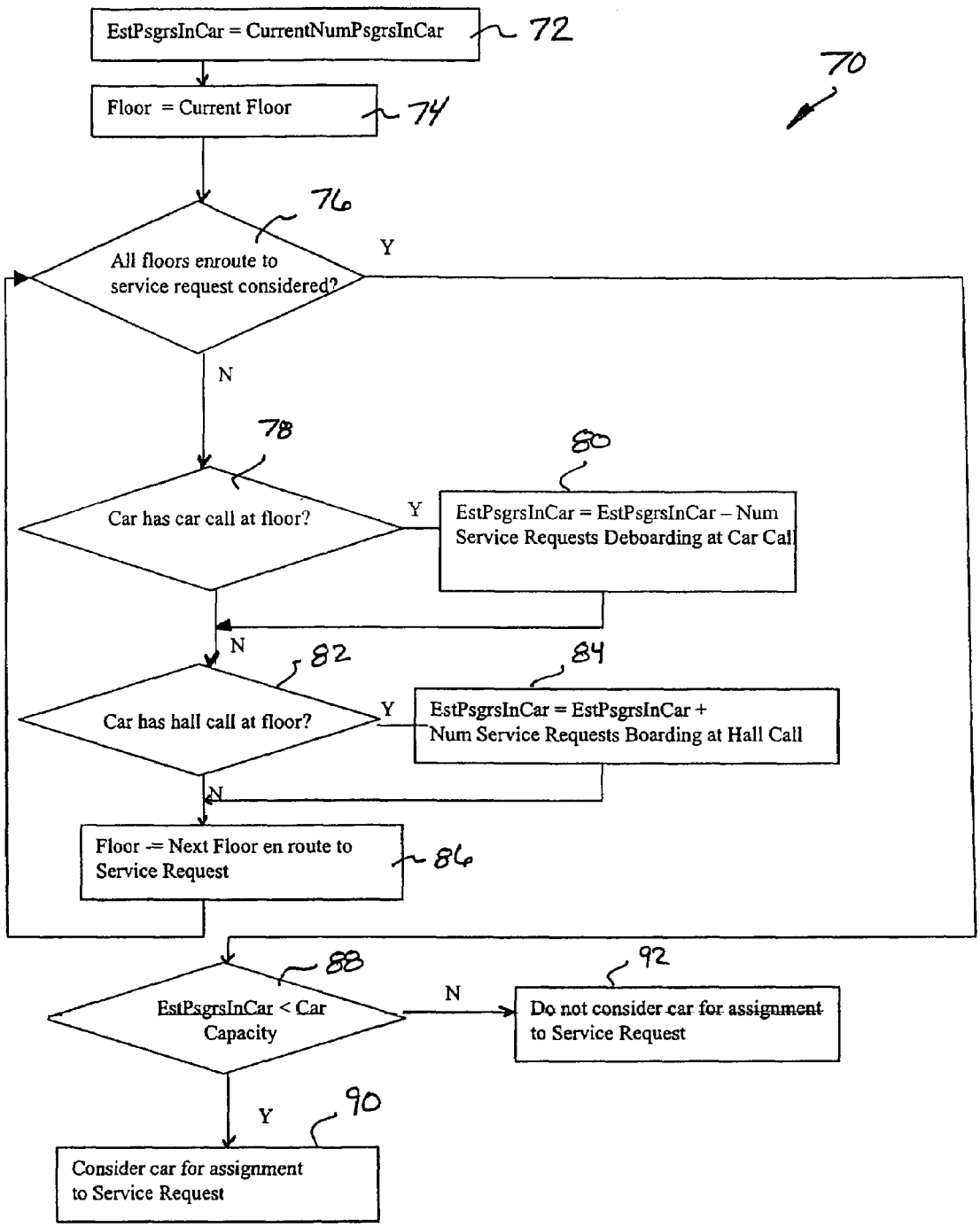
FIG. 3 is a flowchart diagram summarizing one example approach for making a determination regarding an elevator car's capacity to respond to a passenger request.

Another feature of an example embodiment is determining whether a candidate elevator car will have enough capacity to receive a passenger when it arrives at the source landing of the passenger's request, allows any existing passengers to exit the car and boards all other passengers assigned to that car from that source landing. One example approach is summarized in the flowchart 70 of FIG. 3. This example begins at 72 where an estimated number of passengers in the elevator car is set to a current number value. One example utilizes information regarding current assignments and elevator car position and travel direction to determine the current number of passengers. At 74, the example of FIG. 3 begins at a current floor where a candidate elevator car is located. At 76, a determination is made whether the current assignments for that elevator car at all floors between the current floor and the floor of the source landing of the passenger request have been taken into consideration for purposes of determining the available capacity of the elevator car for the passenger under consideration. At 78, a determination is made whether the elevator car has a car call at each floor in route to the source landing. Assuming that there is a car call at a particular floor, the estimated number of passengers in the car is decreased at 80 by subtracting the number of service requests having that floor as the desired destination where a corresponding number of passengers can be assumed to exit the elevator car.

At 82, a determination is made whether the car has been assigned to pick up any passengers at a particular floor. In the event that such an assignment has been made, the number of estimated passengers in the car is increased at 84 according to the number of requests made and assigned to that car. The next floor along the direction of travel toward the source landing is selected at 86 and the process between the steps 76 through 84 repeats as necessary.

Once all appropriate floors have been considered, the estimated number of passengers in the car is compared to the elevator car capacity at 88. In the event that there is enough capacity remaining, that car is considered for possible assignment to service the passenger request at 90. If the estimated number of passengers in that car is at least equal to the car's capacity, that car is not considered for assignment as indicated at 92.

One example includes considering how many passengers have already been assigned to a particular car that will board the car at the same source landing as the passenger request under consideration. This allows for determining whether the elevator will become overcrowded at the source landing before a particular passenger may have an opportunity to board that elevator car.

At the same time, considering what passengers have been assigned to an elevator car allows for one example controller 36 to give a higher priority to one elevator car compared to another. For example, where two elevator cars will both arrive at a source landing at approximately the same time, it is desirable to assign a passenger to an elevator car that already has passengers boarding that elevator car from the source landing. This creates a more natural passenger flow for the individuals boarding an elevator car compared to, for example, assigning several individuals to one elevator car and one individual to another elevator car that will arrive at the source landing and currently is assigned only to drop off individuals at that source landing. People tend to follow other people onto elevator cars rather than boarding a car by themself. One example controller is designed to prioritize elevator car assignments accordingly.

The disclosed example approaches take advantage of information such as that available from destination entry systems. By utilizing a passenger's desired destination in combination with a fuzzy logic assignment algorithm enhances elevator system performance and provides better passenger service. For example, identifying coincident stops for the elevator car (i.e., coincident destinations for assigned passengers), the number of stops an elevator must make to service passengers can be reduced. Further, the disclosed example considers the type of coincident stop for selecting an appropriate fuzzy logic algorithm to apply to achieve the best possible elevator service for a passenger request. The disclosed example effectively replaces the single coincident call fuzzy rule that is used in known elevator systems with a plurality of fuzzy logic algorithms that can be selected based upon the relationship between a passenger request and the current assignments for an elevator car.

Another advantage of the disclosed example is that it estimates whether an elevator car will have enough capacity to receive a particular passenger. This reduces the chance that an elevator car will be too full to serve a request. Therefore, the disclosed example avoids the difficulties and drawbacks associated with arrangements that require a passenger or several passengers to reenter their service request after a car that had been previously assigned to them arrives at the source landing.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system, comprising:

assigning an elevator car to respond to a passenger request that indicates an intended destination before the passenger enters an elevator car based upon the intended destination and a fuzzy logic car assignment algorithm; and preferring to assign an elevator car that is already assigned to carry at least one other passenger from a source landing of the passenger request to the intended destination over at least one other elevator car that is traveling to the source landing without at least one other passenger assigned to board the other elevator car.

2. The method of claim 1, including determining whether a candidate elevator car is currently assigned to travel to the intended destination and using one of a plurality of fuzzy logic car assignment algorithms based upon the determination.

3. The method of claim 2, including using a coincident destination call fuzzy logic algorithm if the candidate elevator car is currently assigned to travel to the intended destination.

4. The method of claim 2, including determining whether the candidate elevator car is assigned to travel to a source landing of the passenger request from which the passenger will board an elevator car to be carried to the intended destination;

determining a type of call the candidate elevator car is assigned to respond to when traveling to the source landing; and selecting a corresponding one of a plurality of fuzzy logic algorithms responsive to the determined type of call.

5. The method of claim 4, including selecting one of a coincident hall call at the source landing and coincident destination call fuzzy logic algorithm, a coincident hall call at the source landing fuzzy logic algorithm, a coincident car call at the source landing and a coincident destination call fuzzy logic algorithm, a coincident car call at the source landing fuzzy logic algorithm or a coincident destination call fuzzy logic algorithm.

6. The method of claim 1, including determining whether a candidate elevator car is assigned to travel to the intended destination or a source landing of the passenger request from which the passenger will board an elevator to be carried to the intended destination and using a no coincident call fuzzy logic algorithm when the candidate elevator car is not assigned to travel to the intended destination or the source landing.

7. The method of claim 1, including determining whether a candidate elevator car will have capacity to accommodate the passenger for responding to the passenger request.

8. The method of claim 7, including determining a capacity of the candidate elevator car to accommodate the passenger based upon a number of passengers currently on the candidate elevator car, a number of passengers expected to leave the candidate elevator car when or before the candidate elevator car reaches a source landing of the passenger request and a number of passengers expected to board the candidate elevator car when or before the candidate elevator car reaches the source landing.

9. The method of claim 8, including determining a number of passengers on the candidate elevator car with the passenger on the candidate car as the candidate car departs the source landing;

assigning the candidate elevator car to respond to the request if the determined number is less than a maximum capacity of the candidate elevator car.

10. A method of controlling an elevator system, comprising:

determining whether an elevator car has enough capacity to respond to a passenger request that indicates an intended destination before the passenger enters an elevator car based upon the intended destination and a destination of any other passenger assigned to the elevator car or currently on the elevator car; and determining a capacity of the elevator car to accommodate the passenger based upon a number of passengers currently on the elevator car, a number of passengers expected to leave the elevator car when or before the elevator car reaches a source landing of the passenger request and a number of passengers expected to board the elevator car when or before the elevator car reaches the source landing.

11. The method of claim 10, including determining a number of passengers on the elevator car with the passenger on the elevator car as the elevator car departs the source landing;

assigning the elevator car to respond to the request if the determined number is less than a maximum capacity of the elevator car.

12. The method of claim 10, including assigning the elevator car to respond to the passenger request based upon the intended destination and a fuzzy logic car assignment algorithm if the elevator car has enough capacity to respond to the request.

13. The method of claim 12, including determining whether the elevator car is currently assigned to travel to the intended destination and using one of a plurality of fuzzy logic car assignment algorithms based upon the determination.

14. The method of claim 13, including determining whether the elevator car is assigned to travel to a source landing of the passenger request from which the passenger will board an elevator car to be carried to the intended destination;

determining a type of call the elevator car is assigned to respond to when traveling to the source landing; and selecting a corresponding one of a plurality of fuzzy logic algorithms responsive to the determined type of call.

15. An elevator system, comprising:

a plurality of elevator cars; and a controller that assigns one of the elevator cars to respond to a passenger request that indicates an intended destination before the passenger enters an elevator car based upon the intended destination and a fuzzy logic car assignment algorithm, wherein the controller determines whether a candidate elevator car will have capacity to receive the passenger for responding to the passenger request, wherein the controller determines a capacity of the candidate elevator car to accommodate the passenger based upon a number of passengers currently on the candidate elevator car, a number of passengers expected to leave the candidate elevator car when or before the candidate elevator car reaches a source landing of the passenger request and a number of passengers expected to board the candidate elevator car when or before the candidate elevator car reaches the source landing.

16. The system of claim 15, wherein the controller determines whether a candidate elevator car is currently assigned to travel to the intended destination and uses one of a plurality of fuzzy logic car assignment algorithms based upon the determination.

17. The system of claim 16, wherein the controller determines whether the candidate elevator car is assigned to travel to a source landing of the passenger request from which the passenger will board an elevator car to be carried to the intended destination;

determines a type of call the candidate elevator car is assigned to respond to when traveling to the source landing; and selects a corresponding one of a plurality of fuzzy logic algorithms responsive to the determined type of call.

18. The system of claim 17, wherein the plurality of fuzzy logic algorithms includes:

a coincident hall call at the source landing and coincident destination call fuzzy logic algorithm, a coincident hall call at the source landing fuzzy Logic algorithm, a coincident car call at the source landing and a coincident destination call fuzzy logic algorithm, a coincident car call at the source landing fuzzy logic algorithm; and a coincident destination call fuzzy logic algorithm.

19. The system of claim 15, wherein the controller determines whether a candidate elevator car is assigned to travel to the intended destination or a source landing of the passenger request from which the passenger will board an elevator to be carried to the intended destination and the controller uses a no coincident call fuzzy logic algorithm when the candidate elevator car is not assigned to travel to the intended destination or the source landing.

20. The system of claim 15, wherein the controller prefers to assign an elevator car that is already assigned to carry at least one other passenger from a source landing of the passenger request to the intended destination over another elevator car that is traveling to the source landing as a destination for at least one other passenger.

21. The system of claim 15, wherein the controller determines a number of passengers on the candidate elevator car with the passenger on the candidate car as the candidate car departs the source landing and assigns the candidate elevator car to respond to the request if the determined number is less than a maximum capacity of the candidate elevator car.

22. A method of controlling an elevator system, comprising:

assigning an elevator car to respond to a passenger request that indicates an intended destination before the passenger enters an elevator car based upon the intended destination and a fuzzy logic car assignment algorithm; and determining whether a candidate elevator car is assigned to travel to the intended destination or a source landing of the passenger request from which the passenger will board an elevator to be carried to the intended destination and using a no coincident call fuzzy logic algorithm when the candidate elevator car is not assigned to travel to the intended destination or the source landing.

23. A method of controlling an elevator system, comprising:

assigning an elevator car to respond to a passenger request tat indicates an intended destination before the passenger enters an elevator car based upon the intended destination and a fuzzy logic car assignment algorithm;

determining whether a candidate elevator car will have capacity to accommodate the passenger for responding to the passenger request; and determining a capacity of the candidate elevator car to accommodate the passenger based upon a number of passengers currently on the candidate elevator car, a number of passengers expected to leave the candidate elevator car when or before the candidate elevator car reaches a source landing of the passenger request and a number of passengers expected to board the candidate elevator car when or before the candidate elevator car reaches the source landing.

24. An elevator system, comprising:

a plurality of elevator cars; and a controller that assigns one of the elevator cars to respond to a passenger request that indicates an intended destination before the passenger enters an elevator car based upon the intended destination and a fuzzy logic car assignment algorithm, wherein the controller determines whether a candidate elevator car is assigned to travel to the intended destination or a source landing of the passenger request from which the passenger will board an elevator to be carried to the intended destination and the controller uses a no coincident call fuzzy logic algorithm when the candidate elevator car is not assigned to travel to the intended destination or the source landing.

25. An elevator system, comprising:

a plurality of elevator cars; and a controller that assigns one of the elevator cars to respond to a passenger request that indicates an intended destination before the passenger enters an elevator car based upon the intended destination and a fuzzy logic car assignment algorithm, wherein the controller prefers to assign an elevator car that is already assigned to carry at least one other passenger from a source landing of the passenger request to the intended destination over another elevator car that is traveling to the source landing as a destination for at least one other passenger.

* * * * *